US011677143B2

(12) United States Patent
McKittrick et al.

(10) Patent No.: US 11,677,143 B2
(45) Date of Patent: Jun. 13, 2023

(54) MAINTAINING A COUPLING GAP USING AN ANTENNA CARRIER IN AN INFORMATION HANDLING SYSTEM

(71) Applicant: Dell Products L.P., Round Rock, TX (US)

(72) Inventors: Allen B. McKittrick, Cedar Park, TX (US); Changsoo Kim, Cedar Park, TX (US)

(73) Assignee: Dell Products L.P., Round Rock, TX (US)

( * ) Notice: Subject to any disclaimer, the term of this patent is extended or adjusted under 35 U.S.C. 154(b) by 138 days.

(21) Appl. No.: 17/443,999

(22) Filed: Jul. 29, 2021

(65) Prior Publication Data

US 2023/0033165 A1 Feb. 2, 2023

(51) Int. Cl.
*H01Q 1/52* (2006.01)
*H01Q 1/24* (2006.01)

(52) U.S. Cl.
CPC ..... *H01Q 1/52* (2013.01); *H01Q 1/24* (2013.01)

(58) Field of Classification Search
CPC ..... H01Q 1/52; H01Q 1/24
USPC ..... 343/878
See application file for complete search history.

(56) References Cited

U.S. PATENT DOCUMENTS 7,760,147 B2 * 7/2010 Nam ..... H01Q 9/0407 343/702
9,748,649 B2 * 8/2017 Park ..... H01Q 21/28
2009/0085822 A1 * 4/2009 Yu ..... H01Q 1/52 343/841
2018/0309189 A1 * 10/2018 Gu ..... H01Q 21/0025

* cited by examiner

*Primary Examiner* — Hai V Tran
(74) *Attorney, Agent, or Firm* — McDermott Will & Emery LLP

(57) ABSTRACT

In one embodiment, a method for maintaining a coupling gap between a coupling element and a radiating element using an antenna carrier includes: applying, by one or more springs disposed on an inner surface of the antenna carrier, a first lateral force on the antenna carrier; causing, by the first lateral force, the antenna carrier to translate outwardly toward an edge of a mounting surface, the antenna carrier slidably coupled to the mounting surface; receiving, by one or more standoffs disposed on an outer surface of the antenna carrier, a second lateral force from an inside surface of a device cover; causing, by the second lateral force, the antenna carrier to translate inwardly away from the edge of the mounting surface; and causing, by the first lateral force and the second lateral force, the standoffs to maintain the coupling gap between the coupling element and the radiating element.

18 Claims, 4 Drawing Sheets

MAINTAINING A COUPLING GAP USING AN ANTENNA CARRIER IN AN INFORMATION HANDLING SYSTEM

BACKGROUND

Field of the Disclosure

The disclosure relates generally to information handling systems, and in particular to maintaining a coupling gap using an antenna carrier in an information handling system.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

SUMMARY

In one embodiment, a disclosed method for maintaining a coupling gap between a coupling element and a radiating element using an antenna carrier in an information handling system includes: applying, by one or more springs disposed on an inner surface of the antenna carrier, a first lateral force on the antenna carrier; causing, by the first lateral force, the antenna carrier to translate outwardly toward an edge of a mounting surface, the antenna carrier slidably coupled to the mounting surface; receiving, by one or more standoffs disposed on an outer surface of the antenna carrier, a second lateral force from an inside surface of a device cover of the information handling system; causing, by the second lateral force, the antenna carrier to translate inwardly away from the edge of the mounting surface; and causing, by the first lateral force and the second lateral force, the standoffs to maintain the coupling gap between the coupling element and the radiating element.

In one or more of the disclosed embodiments, the method further includes: transmitting, by the coupling element, an antenna signal across the coupling gap between the coupling element and the radiating element; and radiating, by the radiating element, the antenna signal outwardly away from the information handling system.

In one or more of the disclosed embodiments, the method further includes: receiving, by a compressible material disposed on a longitudinal surface of the antenna carrier, a first longitudinal force from the inside surface of the device cover; causing, by the first longitudinal force, a compression in the compressible material; and causing, by the compression of the compressible material, the antenna carrier to apply a second longitudinal force on the mounting surface to secure the antenna carrier in a longitudinal position.

In one or more of the disclosed embodiments, the antenna carrier is slidably coupled to the mounting surface by two or more shank screws disposed on opposite ends of the antenna carrier.

In one or more of the disclosed embodiments, the coupling element is disposed on the outer surface of the antenna carrier using a Laser Direct Structuring (LDS) process.

In one or more of the disclosed embodiments, the coupling gap between the coupling element and the radiating element is 0.2 to 1.2 millimeters (mm).

In one or more of the disclosed embodiments, the first lateral force and the second lateral force are equal in magnitude causing the antenna carrier to be in a stable equilibrium.

In one or more of the disclosed embodiments, the radiating element comprises a metal portion of the device cover.

The details of one or more embodiments of the subject matter described in this specification are set forth in the accompanying drawings and the description below. Other potential features, aspects, and advantages of the subject matter will become apparent from the description, the drawings, and the claims.

DESCRIPTION OF PARTICULAR EMBODIMENT(S)

Figure 1:
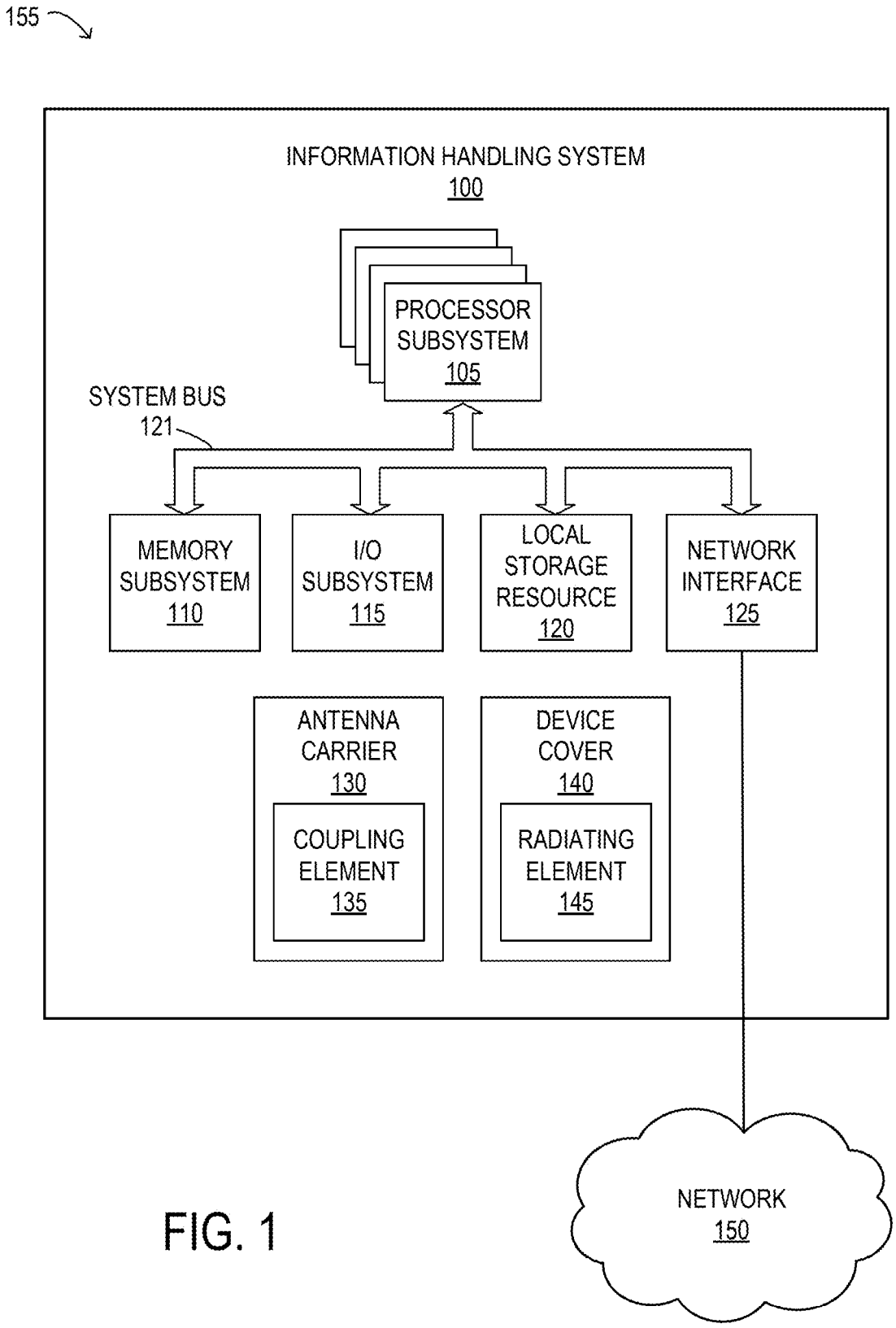
FIG. 1 is a block diagram of selected elements of an embodiment of an information handling system.

This document describes a method for maintaining a coupling gap between a coupling element and a radiating element using an antenna carrier in an information handling system that includes: applying, by one or more springs disposed on an inner surface of the antenna carrier, a first lateral force on the antenna carrier; causing, by the first lateral force, the antenna carrier to translate outwardly toward an edge of a mounting surface, the antenna carrier slidably coupled to the mounting surface; receiving, by one or more standoffs disposed on an outer surface of the antenna carrier, a second lateral force from an inside surface of a device cover of the information handling system; causing, by the second lateral force, the antenna carrier to translate inwardly away from the edge of the mounting surface; and causing, by the first lateral force and the second lateral force, the standoffs to maintain the coupling gap between the coupling element and the radiating element.

In the following description, details are set forth by way of example to facilitate discussion of the disclosed subject matter. It should be apparent to a person of ordinary skill in the field, however, that the disclosed embodiments are exemplary and not exhaustive of all possible embodiments.

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory (SSD); as well as communications media such wires, optical fibers, microwaves, radio waves, and other electromagnetic and/or optical carriers; and/or any combination of the foregoing.

Particular embodiments are best understood by reference to FIGS. 1-4 wherein like numbers are used to indicate like and corresponding parts.

Turning now to the drawings, FIG. 1 is a block diagram of selected elements of an embodiment of a computing environment that includes an information handling system. Specifically, FIG. 1 illustrates a block diagram depicting selected elements of an information handling system 100 in accordance with some embodiments of the present disclosure. In other embodiments, information handling system 100 may represent different types of portable information handling systems, such as, display devices, head mounted displays, head mount display systems, smart phones, tablet computers, notebook computers, media players, foldable display systems, digital cameras, 2-in-1 tablet-laptop combination computers, and wireless organizers, or other types of portable information handling systems. In one or more embodiments, information handling system 100 may also represent other types of information handling systems, including desktop computers, server systems, controllers, and microcontroller units, among other types of information handling systems.

In the embodiment illustrated in FIG. 1, components of information handling system 100 may include, but are not limited to, a processor subsystem 105, which may comprise one or more processors, and system bus 121 that communicatively couples various system components to processor subsystem 105 including, for example, a memory subsystem 110, an I/O subsystem 115, a local storage resource 120, and a network interface 125. System bus 121 may represent a variety of suitable types of bus structures (e.g., a memory bus, a peripheral bus, or a local bus) using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express (PCIe) bus, HyperTransport (HT) bus, and Video Electronics Standards Association (VESA) local bus. As shown in FIG. 1, information handling system 100 may additionally include an antenna carrier 130 that includes a coupling element 135 and a device cover 140 than includes a radiating element 145. In other embodiments, computing environment 155 may include additional, fewer, and/or different components than the components shown in FIG. 1.

In information handling system 100, processor subsystem 105 may comprise a system, device, or apparatus operable to interpret and/or execute program instructions and/or process data, and may include a microprocessor, microcontroller, digital signal processor (DSP), application specific integrated circuit (ASIC), or another digital or analog circuitry configured to interpret and/or execute program instructions and/or process data. In some embodiments, processor subsystem 105 may interpret and/or execute program instructions and/or process data stored locally (e.g., in memory subsystem 110 and/or another component of information handling system 100). In the same or alternative embodiments, processor subsystem 105 may interpret and/or execute program instructions and/or process data stored remotely. In one embodiment, processor subsystem 105 may be or include a multi-core processor comprised of one or more processing cores disposed upon an integrated circuit (IC) chip. In other embodiments, processor subsystem 105 may be or include an integrated device (e.g., microcontroller, system on a chip (SoC), and the like) that includes memory, peripheral interfaces, and/or other components suitable for interpreting and/or executing program instructions and/or processing data.

In one embodiment, memory subsystem 110 may comprise a system, device, or apparatus operable to retain and/or retrieve program instructions and/or data for a period of time (e.g., computer-readable media). Memory subsystem 110 may comprise random access memory (RAM), electrically erasable programmable read-only memory (EEPROM), a PCMCIA card, flash memory, magnetic storage, opto-magnetic storage, and/or a suitable selection and/or array of volatile or non-volatile memory that retains data after power to its associated information handling system, such as system 100, is powered down.

In one embodiment, I/O subsystem 115 may comprise a system, device, or apparatus generally operable to receive and/or transmit data to, from, and/or within information handling system 100. I/O subsystem 115 may represent, for example, a variety of communication interfaces, graphics interfaces, video interfaces, user input interfaces, and/or peripheral interfaces. In various embodiments, I/O subsystem 115 may be used to support various peripheral devices, such as a touch panel, a display adapter, a keyboard, an accelerometer, a touch pad, a gyroscope, an IR sensor, a microphone, a sensor, a camera, or another type of peripheral device.

In one embodiment, local storage resource 120 may comprise computer-readable media (e.g., hard disk drive, floppy disk drive, CD-ROM, and/or other type of rotating storage media, flash memory, EEPROM, and/or another type of solid state storage media) and may be generally operable to store instructions and/or data.

In one embodiment, network interface 125 may be a suitable system, apparatus, or device operable to serve as an interface between information handling system 100 and a network 150. Network interface 125 may enable information handling system 100 to communicate over network 150 using a suitable transmission protocol and/or standard, including, but not limited to, transmission protocols and/or standards enumerated below with respect to the discussion of network 150. Network 150 may be a public network or a private (e.g. corporate) network. The network may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and/or messages (generally referred to as data). Network interface 125 may enable wired and/or wireless communications (e.g., NFC or Bluetooth) to and/or from information handling system 100.

In particular embodiments, network 150 may include one or more routers for routing data between client information handling systems 100 and server information handling systems 100. A device (e.g., a client information handling system 100 or a server information handling system 100) on network 150 may be addressed by a corresponding network address including, for example, an Internet protocol (IP) address, an Internet name, a Windows Internet name service (WINS) name, a domain name or other system name. In particular embodiments, network 150 may include one or more logical groupings of network devices such as, for example, one or more sites (e.g. customer sites) or subnets. As an example, a corporate network may include potentially thousands of offices or branches, each with its own subnet (or multiple subnets) having many devices. One or more client information handling systems 100 may communicate with one or more server information handling systems 100 via any suitable connection including, for example, a modem connection, a LAN connection including the Ethernet or a broadband WAN connection including DSL, Cable, Ti, T3, Fiber Optics, Wi-Fi, or a mobile network connection including GSM, GPRS, 3G, or WiMax.

In one embodiment, network 150 may transmit data using a desired storage and/or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), and/or any combination thereof. Network 150 and its various components may be implemented using hardware, software, or any combination thereof.

In one embodiment, device cover 140 may be a suitable system, apparatus, or device operable to house one or more components of information handling system 100. In particular, device cover 140 may be comprised of a rigid material (e.g., aluminum) and/or semi-rigid material (e.g., plastic) operable to provide a housing for one or more components within information handling system 100. In one embodiment, device cover 140 may be or include a bottom cover, or "D cover," for information handling system 100. In other embodiments, device cover 140 may be or include a top cover, or "A cover," and/or any other cover or shell suitable for housing one or more components of information handling system 100. In the embodiment illustrated in FIG. 1, device cover 140 includes a radiating element 145. Device cover 140 is described in further detail with respect to FIGS. 3A and 3B.

In one embodiment, radiating element 145 may be a suitable system, apparatus, or device operable to radiate, or otherwise transmit, an antenna signal transmitted by coupling element 135. In particular, radiating element 145 may be or include a passive element comprised of a rigid material (e.g., aluminum) of device cover 140 operable to receive an antenna signal transmitted by coupling element 135 across a coupling gap (e.g., coupling gap 320 shown in FIG. 3B) between coupling element 135 and radiating element 145 in which coupling element 135 and radiating element 145 may be capacitively coupled. Once received, radiating element 145 may radiate the antenna signal outwardly away from information handling system 100. For example, radiating element 145 may radiate the antenna signal outwardly away from information handling system 100 to be received by an access point (AP) (not shown in FIG. 1) and transmitted throughout network 150. In one embodiment, radiating element 145 may comprise a metal portion of device cover 140. In another embodiment, radiating element 145 may be or include a passive network operable to match impedance between coupling element 135 and a receiver (not shown in FIG. 1) of computing environment 155. Radiating element 145 is described in further detail with respect to FIGS. 3A and 3B.

In one embodiment, coupling element 135 may be a suitable system, apparatus, or device operable to radiate, or otherwise transmit, energy. Specifically, coupling element 135 may be or include an antenna operable to radiate energy, or an "antenna signal," in the form of electromagnetic waves. That is, coupling element 135 may receive electrical signals (e.g., electric current) from one or more components of information handling system 100 and may transmit an antenna signal across a coupling gap between coupling element 135 and radiating element 145 that conveys the electrical signals received by coupling element 135. In one embodiment, coupling element 135 may be or include one or more traces (e.g., a metal additive that forms a micro-rough track) comprising an antenna that may be written, or otherwise structured, onto a thermoplastic material doped with non-conductive metallic inorganic compounds using a Laser Direct Structuring (LDS) process. In another embodiment, coupling element 135 may be formed using flexible printing and/or metal stamping processes. In other embodiments, coupling element 135 may be or include a short dipole antenna, a dipole antenna, a slot antenna, and/or any other type of antenna suitable for transmitting energy. Coupling element 135 is described in further detail with respect to FIGS. 3A and 3B.

In one embodiment, antenna carrier 130 may be a suitable system, apparatus, or device operable to maintain a coupling gap between coupling element 135 and radiating element 145. In particular, antenna carrier 130 may be or include an antenna housing comprised of a semi-rigid material (e.g., plastic, thermoplastic, and the like) operable to position, or otherwise orient, coupling element 135 at an immutable, or absolute, distance away from radiating element 145 to ensure optimal coupling (i.e., matched impedances). Conventionally, antennas (e.g., WLAN antennas) used to support wireless fidelity (Wi-Fi) connectivity in information handling systems may require bucket housings having lengthy (e.g., 45 millimeters) slots within device covers (e.g., D covers). However, these lengthy slots used to house conventional antennas may severely limit the number of I/O ports and/or speakers made available to users, thereby decreasing overall user experience. Further, such conventional systems may lack internal structures or systems required for tolerance control with respect to coupling gaps between the conventional antennas and receivers, thereby severely limiting overall antenna performance (e.g., 7 GHz performance).

In contrast, antenna carrier 130 may provide an antenna housing for coupling element 135 that allows a decreased antenna length (e.g., 23 millimeters) while providing an immutable, or absolute, coupling gap (e.g., an absolute coupling gap of 0.2 to 1.2 millimeters) to ensure consistent tolerance control within information handling system 100. This coupling gap between coupling element 135 and radiating element 145 is immutable, or absolute, in that antenna carrier 130 may be wedged securely into position (e.g., by a manufacturer) such that the position of antenna carrier 130, and the coupling element 135 thereon, within information handling system 100 may not be perturbed, or jarred, despite changes in orientation of information handling system 100, thereby increasing overall user experience. Antenna carrier 130 is described in greater detail with respect to FIGS. 2A-3B.

Figure 2A:
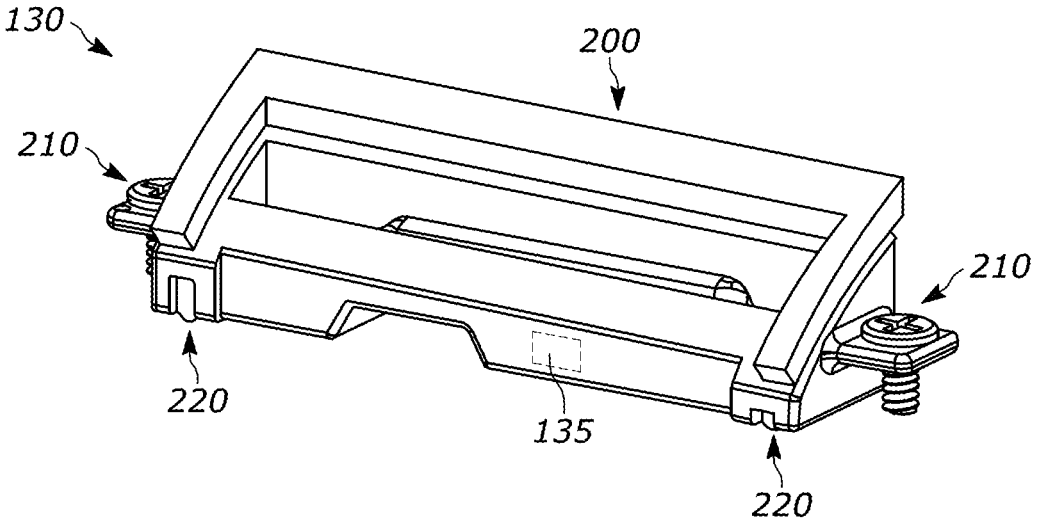
FIGS. 2A and 2B are three-quarter views of selected elements of an embodiment of an antenna carrier.
Figure 2B:
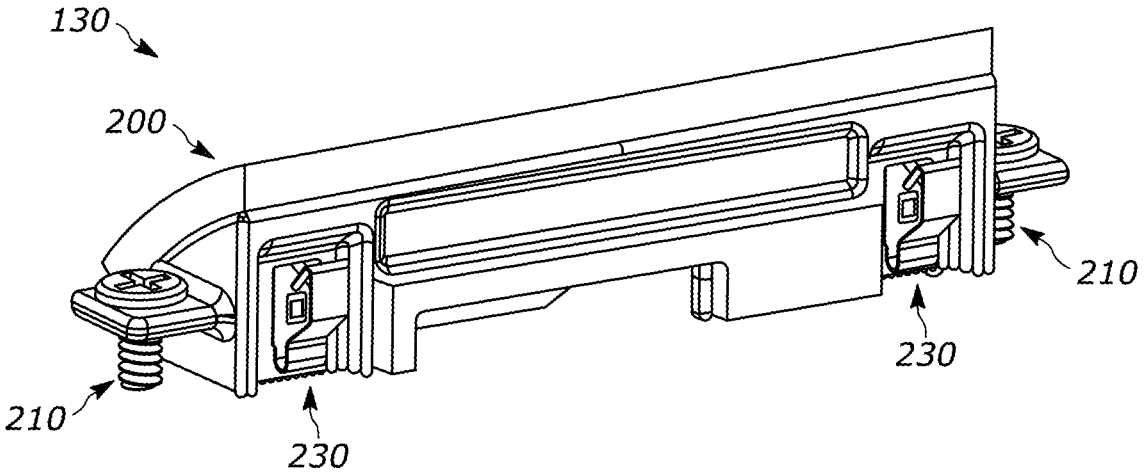

FIGS. 2A and 2B are three-quarter views of selected elements of an embodiment of an antenna carrier. As described above, antenna carrier 130 may provide an immutable, or absolute, coupling gap to ensure consistent tolerance control within information handling system 100. In the embodiment illustrated in FIGS. 2A and 2B, antenna carrier 130 includes a coupling element 135 (described above with respect to FIG. 1), a compressible material 200, one or more standoffs 220, two or more shank screws 210, and one or more springs 230. In other embodiments, antenna carrier 130 may include additional, fewer, and/or different components than the components shown in FIGS. 2A and 2B.

In one embodiment, compressible material 200 may be a suitable system, apparatus, or device operable to cushion and secure antenna carrier 130 in a longitudinal position within information handling system 100. As shown in FIGS. 2A and 2B, compressible material 200 may be disposed on a longitudinal surface (i.e., top surface and/or bottom surface) of antenna carrier 130 such that compressible material 200 may receive a longitudinal force applied by device cover 140. Specifically, compressible material 200 may receive a longitudinal force from an inside surface of device cover 140 (e.g., during an installation of device cover 140) such that antenna carrier 130 may, in turn, apply a longitudinal force on a mounting surface (e.g., mounting surface 310 shown in FIGS. 3A and 3B) to secure antenna carrier 130 in a longitudinal position, or along the z axis, upon the mounting surface. In one embodiment, compressible material 200 may be or include a sponge coupled to antenna carrier 130 to receive longitudinal forces applied to antenna carrier 130. In other embodiments, compressible material 200 may be or include a polymeric foam, cork, rubber, and/or any other type of organic and/or inorganic material operable to cushion and secure antenna carrier 130 in a longitudinal position within information handling system 100. Compressible material 200 is described in greater detail with respect to FIGS. 3A and 3B.

In one embodiment, each standoff 220 (collectively referred to herein as "standoffs 220) may be a suitable system, apparatus, or device operable to maintain a coupling gap between coupling element 135 and radiating element 145. In particular, each standoff 220 may be or include a standoff or spacer comprised of a semi-rigid material (e.g., plastic, thermoplastic, and the like) operable to establish and maintain the coupling gap between coupling element 135 and radiating element 145 to ensure optimal coupling (i.e., matched impedances). In the embodiment illustrated in FIGS. 2A and 2B, standoffs 220 are disposed on an outer surface of antenna carrier 130 to receive a lateral force applied by device cover 140. In particular, standoffs 220 may receive a lateral force from an inside surface of device cover 140 (e.g., during an installation of device cover 140) such that antenna carrier 130 may, in combination with additional lateral forces, be secured in a lateral position within information handling system 100. In one embodiment, standoffs 220 may be comprised of the same material as that of antenna carrier 130. For example, antenna carrier 130 may be manufactured using an injection molding process such that standoffs 220 extend beyond the outer surface of antenna carrier 130 to maintain a coupling gap between coupling element 135 and radiating element 145. In another embodiment, standoffs 220 may be comprised of a different material as that of antenna carrier 130. For example, standoffs 220 may be comprised of a metal, plastic, or glass material coupled to the outer surface of antenna carrier 130 during a manufacturing process. Standoffs 220 are described in greater detail with respect to FIGS. 3A and 3B.

In one embodiment, each shank screw 210 (collectively referred to herein as "shank screws 210") may be a suitable system, apparatus, or device operable to slidably couple antenna carrier 130 to a mounting surface (e.g., mounting surface 310 shown in FIGS. 3A and 3B) within information handling system 100. In the embodiment illustrated in FIGS. 2A and 2B, shank screws 210 may be disposed on opposite ends of antenna carrier 130 to allow a lateral motion of antenna carrier 130 in relation to the mounting surface upon which antenna carrier 130 is mounted. That is, each shank screw 210 may include a smooth, threadless portion disposed proximate to the screw head (i.e., above the threads of shank screw 210) that, when screwed into a threaded bore of the mounting surface, allows antenna carrier 130 to translate back and forth along the mounting surface. As such, antenna carrier 130 may be slidably coupled to the mounting surface, allowing antenna carrier 130 to traverse in a lateral motion as antenna carrier 130 receives various lateral forces applied to secure antenna carrier 130 into an immutable, or absolute, position to ensure optimal coupling between coupling element 135 and radiating element 145.

In one embodiment, each spring 230 (collectively referred to herein as "springs 230") may be a suitable system, apparatus, or device operable to apply a lateral force used, in part, to secure antenna carrier 130 in a lateral position within information handling system 100. In the embodiment illustrated in FIGS. 2A and 2B, springs 230 may be disposed on an inner surface of antenna carrier 130 (i.e., in relation to an outside edge of mounting surface 310 shown in FIGS. 3A and 3B) to apply a lateral force upon antenna carrier 130. The lateral force applied by springs 230 may cause antenna carrier 130 to translate (e.g., via shank screws 210) outwardly toward the edge of the mounting surface upon which antenna carrier 130 is mounted such that antenna carrier 130 may, in combination with additional lateral forces, be secured in a lateral position within information handling system 100. In one embodiment, springs 230 may be or include one or more compression springs disposed on the inner surface of antenna carrier 130. In other embodiments, springs 230 may be or include one or more extension springs, torsion springs, constant force springs, and/or any other spring suitable for applying a lateral force to secure antenna carrier 130 in a lateral position within information handling system 100. Springs 230 are described in greater detail with respect to FIGS. 3A and 3B.

Figure 3A:
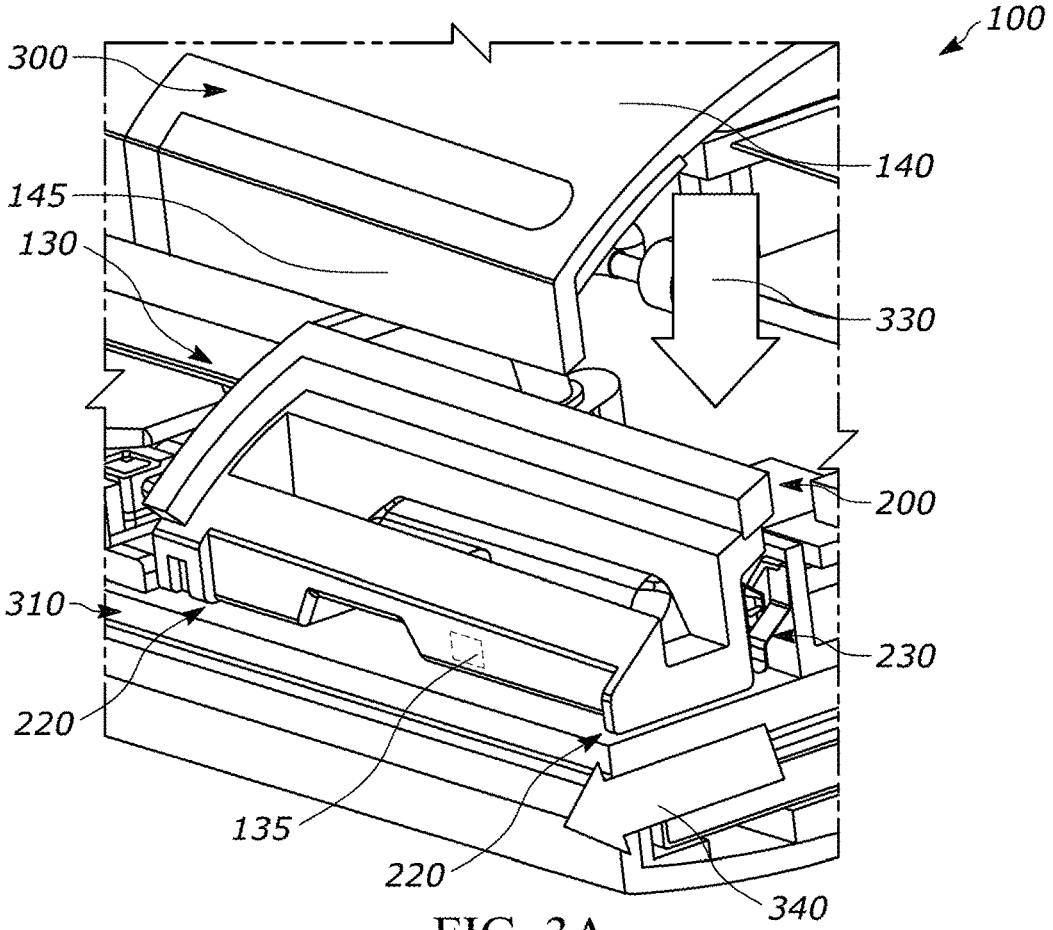
FIGS. 3A and 3B are three-quarter views of selected elements of an embodiment of an antenna carrier and a device cover.
Figure 3B:
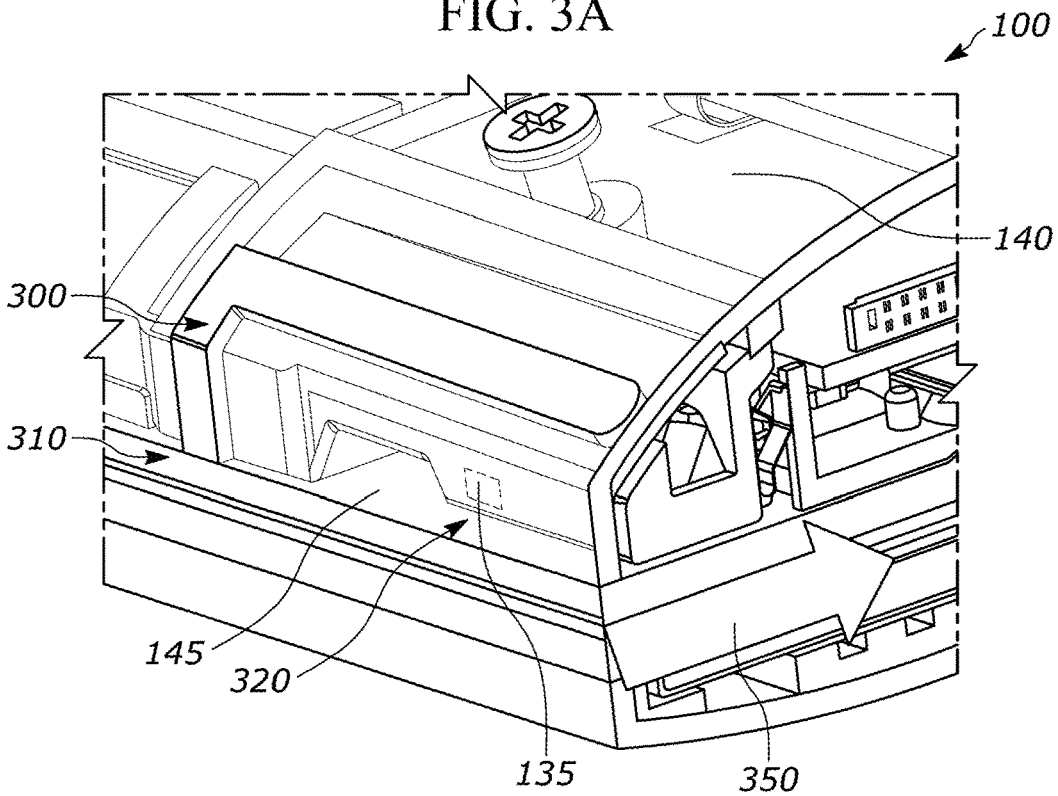

FIGS. 3A and 3B are three-quarter views of selected elements of an embodiment of an antenna carrier and a device cover. In the embodiment illustrated in FIGS. 3A and 3B, information handling system 100 includes device cover 140, antenna carrier 130, and mounting surface 310. Device cover 140 includes radiating element 145 (described above with respect to FIG. 1) and a plastic element 300. In one embodiment, plastic element 300 may be directly bonded into device cover 140 using Nano Molding Technology (NMT) to create an opening, or break, in the rigid material comprising device cover 140, thereby generating an open circuit through which an antenna signal may radiate. Antenna carrier 130 includes a coupling element 135, a compressible material 200, one or more standoffs 220, two or more shank screws 210 (not shown in figures), and one or more springs 230 as described above with respect to FIGS. 2A and 2B. In other embodiments, information handling system 100 may include additional, fewer, and/or different components than the components shown in FIGS. 3A and 3B.

In one embodiment, compressible material 200 may receive a longitudinal force from the inside surface of device cover 140. This is shown in FIGS. 3A and 3B where the inside surface of device cover 140 applies a longitudinal force 330 upon compressible material 200 of antenna carrier 130 as device cover 140 is secured to, or otherwise installed on, information handling system 100 (as shown in FIG. 3B). This longitudinal force 330 may cause a compression in compressible material 200 as device cover 140 is secured which may, in turn, cause antenna carrier 130 to apply a longitudinal force on mounting surface 310. The longitudinal force applied by antenna carrier 130 upon mounting surface 310 may cause antenna carrier 130 to be secured in a longitudinal position, or along the z axis, as described above with respect to FIGS. 2A and 2B.

In addition to the longitudinal force 330 described above, springs 230 may apply a lateral force on antenna carrier 130. In particular, springs 230 may apply a lateral force 340 upon antenna carrier 130 causing antenna carrier 130 to translate (e.g., via shank screws 210 shown in FIGS. 2A and 2B) outwardly toward the edge of mounting surface 310 as shown in FIG. 3A. Similarly, standoffs 220 may receive a lateral force from the inside surface of device cover 140. Specifically, the inside surface of device cover 140 may apply a lateral force 350 on standoffs 220 as device cover 140 is secured to, or otherwise installed on, information handling system 100 (as shown in FIG. 3B). This lateral force 350 may cause antenna carrier 130 to translate inwardly away from the edge of mounting surface 310 which may, in turn, cause antenna carrier 130 to be secured in a lateral position as described above with respect to FIGS. 2A and 2B. Here, the lateral force 340 applied by springs 230 and the lateral force 350 applied by the inside surface of device cover 140 may cause standoffs 220 to maintain the coupling gap 320 between coupling element 135 and radiating element 145 as shown in FIG. 3B. That is, lateral force 340 and lateral force 350 may be equal in magnitude thereby causing antenna carrier 130 to be in a stable equilibrium as the coupling gap 320 remains in an immutable, or absolute, position (e.g., 0.2 to 1.2 millimeter coupling gap) to ensure optimal coupling between coupling element 135 and radiating element 145. This optimal coupling allows coupling element 135 to transmit an antenna signal across coupling gap 320 such that radiating element 145 may radiate the antenna signal outwardly away from information handling system 100.

Figure 4:
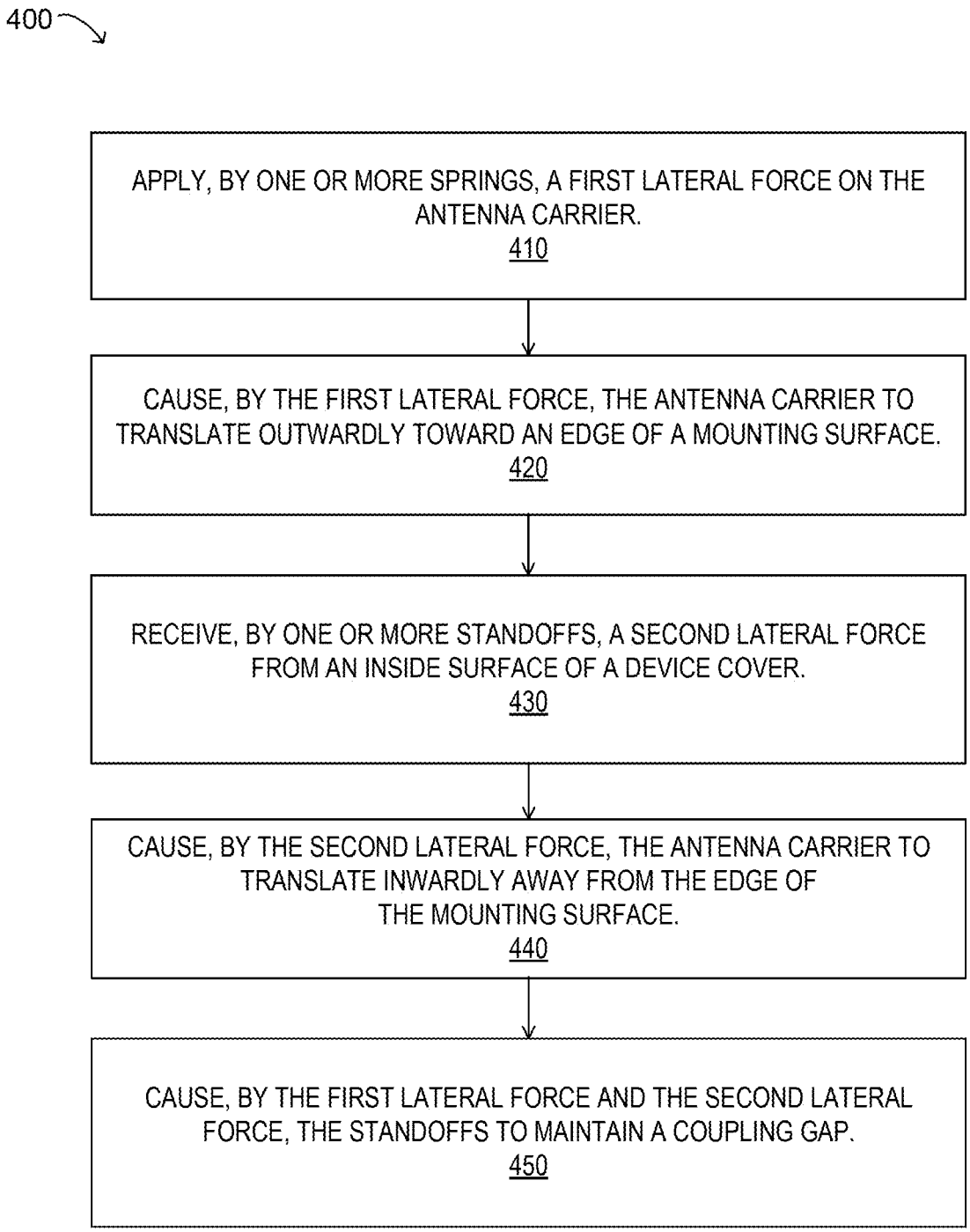
FIG. 4 is a flowchart depicting selected elements of an embodiment of a method for maintaining a coupling gap between a coupling element and a radiating element using an antenna carrier in an information handling system.

FIG. 4 is a flowchart depicting selected elements of an embodiment of a method for maintaining a coupling gap between a coupling element and a radiating element using an antenna carrier in an information handling system. It is noted that certain operations described in method 400 may be optional or may be rearranged in different embodiments.

Method 400 may begin at steps 410 and 420, where one or more springs disposed on an inner surface of the antenna carrier may apply a first lateral force on the antenna carrier causing the antenna carrier to translate outwardly toward an edge of a mounting surface. The antenna carrier may be slidably coupled to the mounting surface. For example, springs 230 may apply a lateral force 340 upon antenna carrier 130 causing antenna carrier 130 to translate outwardly toward the edge of mounting surface 310 as described above with respect to FIGS. 3A and 3B. Shank screws 210 may be disposed on opposite ends of antenna carrier 130 to allow a lateral motion of antenna carrier 130 in relation to the mounting surface upon which antenna carrier 130 is mounted as described above with respect to FIGS. 2A and 2B. In step 430, one or more standoffs disposed on an outer surface of the antenna carrier may receive a second lateral force from an inside surface of a device cover of the information handling system. For example, the inside surface of device cover 140 may apply a lateral force 350 on standoffs 220 as device cover 140 is secured to, or otherwise installed on, information handling system 100 as described above with respect to FIGS. 3A and 3B. In step 440, the second lateral force may cause the antenna carrier to translate inwardly away from the edge of the mounting surface. For example, lateral force 350 may cause antenna carrier 130 to translate inwardly away from the edge of mounting surface 310 which may, in turn, cause antenna carrier 130 to be secured in a lateral position as described above with respect to FIGS. 3A and 3B. In step 450, the first lateral force and the second lateral force may cause the standoffs to maintain the coupling gap between the coupling element and the radiating element. For example, the lateral force 340 applied by springs 230 and the lateral force 350 applied by the inside surface of device cover 140 may cause standoffs 220 to maintain the coupling gap 320 between coupling element 135 and radiating element 145 as described above with respect to FIGS. 3A and 3B.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated other-wise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, features, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

What is claimed is:

1. A method for maintaining a coupling gap between a coupling element and a radiating element using an antenna carrier in an information handling system, the method comprising:

applying, by one or more springs disposed on an inner surface of the antenna carrier, a first lateral force on the antenna carrier along a first direction;

causing, by the first lateral force, the antenna carrier to translate outwardly toward an edge of a mounting surface along the first direction, the antenna carrier slidably coupled to the mounting surface;

receiving, by one or more standoffs disposed on an outer surface of the antenna carrier, a second lateral force from an inside surface of a device cover of the information handling system along a second direction, the second direction opposite to the first direction;

causing, by the second lateral force, the antenna carrier to translate inwardly away from the edge of the mounting surface along the second direction;

causing, by the first lateral force and the second lateral force, the one or more standoffs to maintain the coupling gap between the coupling element and the radiating element;

receiving, by a compressible material disposed on a longitudinal surface of the antenna carrier, a first longitudinal force from the inside surface of the device cover along a third direction, the third direction orthogonal to the first and the second directions;

causing, by the first longitudinal force, a compression in the compressible material; and causing, by the compression of the compressible material, the antenna carrier to apply a second longitudinal force on the mounting surface to secure the antenna carrier in a longitudinal position.

2. The method of claim 1, further comprising:

transmitting, by the coupling element, an antenna signal across the coupling gap between the coupling element and the radiating element; and radiating, by the radiating element, the antenna signal outwardly away from the information handling system.

3. The method of claim 1, wherein the antenna carrier is slidably coupled to the mounting surface by two or more shank screws disposed on opposite ends of the antenna carrier.

4. The method of claim 1, wherein the coupling element is disposed on the outer surface of the antenna carrier using a Laser Direct Structuring (LDS) process.

5. The method of claim 1, wherein the coupling gap between the coupling element and the radiating element is between 0.2 to 1.2 millimeters (mm).

6. The method of claim 1, wherein the first lateral force and the second lateral force are equal in magnitude causing the antenna carrier to be in a stable equilibrium.

7. The method of claim 1, wherein the radiating element comprises a metal portion of the device cover.

8. The method of claim 1, wherein i) the coupling gap is maintained between the coupling element and the radiating element and ii) the antenna carrier is secured in the longitudinal position to secure a position of the antenna carrier with respect to any orientation of the information handling system.

9. An information handling system, comprising:

at least one processor;

a device cover including a radiating element;

an antenna carrier including:

a coupling element disposed on an outer surface of the antenna carrier, the coupling element configured to transmit an antenna signal across a coupling gap between the coupling element and the radiating element, the radiating element configured to radiate the antenna signal outwardly away from the information handling system;

one or more springs disposed on an inner surface of the antenna carrier, the one or more springs configured to apply a first lateral force on the antenna carrier along a first direction, the first lateral force causing the antenna carrier to translate outwardly toward an edge of a mounting surface along the first direction, the antenna carrier slidably coupled to the mounting surface; and one or more standoffs disposed on the outer surface of the antenna carrier, the one or more standoffs configured to receive a second lateral force from an inside surface of the device cover along a second direction opposite to the first direction, the second lateral force causing the antenna carrier to translate inwardly away from the edge of the mounting surface along the second direction, the first lateral force and the second lateral force causing the one or more standoffs to maintain the coupling gap between the coupling element and the radiating element; and a compressible material disposed on a longitudinal surface of the antenna carrier, the compressible material configured to receive a first longitudinal force from the inside surface of the device cover along a third direction, the third direction orthogonal to the first and the second directions, the first longitudinal force causing a compression of the compressible material, the compression of the compressible material causing the antenna carrier to apply a second longitudinal force on the mounting surface to secure the antenna carrier in a longitudinal position.

10. The information handling system of claim 9, wherein the antenna carrier further includes:

two or more shank screws disposed on opposite ends of the antenna carrier, the two or more shank screws configured to slidably couple the antenna carrier to the mounting surface.

11. The information handling system of claim 9, wherein the coupling element is disposed on the outer surface of the antenna carrier using a Laser Direct Structuring (LDS) process.

12. The information handling system of claim 9, wherein the coupling gap between the coupling element and the radiating element is 0.2 to 1.2 millimeters (mm).

13. The information handling system of claim 9, wherein the first lateral force and the second lateral force are equal in magnitude causing the antenna carrier to be in a stable equilibrium.

14. The information handling system of claim 9, wherein the radiating element comprises a metal portion of the device cover.

15. An antenna carrier of an information handling system, the antenna carrier comprising:

a coupling element disposed on an outer surface of the antenna carrier, the coupling element configured to transmit an antenna signal across a coupling gap between the coupling element and a radiating element of a device cover of the information handling system, the radiating element configured to radiate the antenna signal outwardly away from the information handling system;

one or more springs disposed on an inner surface of the antenna carrier, the one or more springs configured to apply a first lateral force on the antenna carrier along a first direction, the first lateral force causing the antenna carrier to translate outwardly toward an edge of a mounting surface along the first direction, the antenna carrier slidably coupled to the mounting surface; and one or more standoffs disposed on the outer surface of the antenna carrier, the one or more standoffs configured to receive a second lateral force from an inside surface of the device cover along a second direction opposite to the first direction, the second lateral force causing the antenna carrier to translate inwardly away from the edge of the mounting surface along the second direction, the first lateral force and the second lateral force causing the one or more standoffs to maintain the coupling gap between the coupling element and the radiating element; and a compressible material disposed on a longitudinal surface of the antenna carrier, the compressible material configured to receive a first longitudinal force from the inside surface of the device cover along a third direction, the third direction orthogonal to the first and the second directions, the first longitudinal force causing a compression of the compressible material, the compression of the compressible material causing the antenna carrier to apply a second longitudinal force on the mounting surface to secure the antenna carrier in a longitudinal position.

16. The antenna carrier of claim 15, wherein the antenna carrier further includes:

two or more shank screws disposed on opposite ends of the antenna carrier, the two or more shank screws configured to slidably couple the antenna carrier to the mounting surface.

17. The antenna carrier of claim 15, wherein the coupling element is disposed on the outer surface of the antenna carrier using a Laser Direct Structuring (LDS) process.

18. The antenna carrier of claim 15, wherein the coupling gap between the coupling element and the radiating element is 0.2 to 1.2 millimeters (mm).

* * * * *